United States Patent [19]

Wionsek

[11] Patent Number: 4,938,427

[45] Date of Patent: Jul. 3, 1990

[54] APPARATUS FOR FRICTIONAL SURFACE DRIVING OF A CROSS-WOUND BOBBIN

[75] Inventor: Horst Wionsek, Monchen-Gladbach, Fed. Rep. of Germany

[73] Assignee: W. Schlafhorst & Co., Fed. Rep. of Germany

[21] Appl. No.: 374,158

[22] Filed: Jun. 29, 1989

[30] Foreign Application Priority Data

Jul. 9, 1988 [DE] Fed. Rep. of Germany ..... 3823403

[51] Int. Cl.[5] ..... B65H 54/46

[52] U.S. Cl. ..... 242/18 DD

[58] Field of Search ..... 242/18 DD

[56] References Cited

U.S. PATENT DOCUMENTS

| | | | |
|---|---|---|---|
| 4,089,480 | 5/1978 | Kamp | 242/18 DD |
| 4,415,125 | 11/1983 | Schwengeler | 242/18 DD |
| 4,695,000 | 9/1987 | Fretz et al. | 242/18 DD |

FOREIGN PATENT DOCUMENTS

| | | |
|---|---|---|
| 0063690 | 3/1982 | European Pat. Off. . |
| 0230943 | 1/1987 | European Pat. Off. . |
| 3446259 | 6/1986 | Fed. Rep. of Germany . |

*Primary Examiner*—Stanley N. Gilreath

*Attorney, Agent, or Firm*—Shefte, Pinckney & Sawyer

[57] ABSTRACT

Apparatus for frictional surface driving of a textile bobbin during cross-winding utilizes three or more annular drive bodies rotatably supported axially adjacent one another on a central drive shaft with a transmission mechanism intermediate adjacent pairs of the drive bodies for coupling them in driven relation to the drive shaft and in speed-change relation to one another. The driving apparatus is thereby particularly adapted for peripheral driving of a conical bobbin during winding, at least two of the annular drive bodies preferably being utilized for peripheral driving engagement with the bobbin. The speed-change ratios are predetermined as a function of the rotational speed of the drive shaft and the conicity of the bobbin.

22 Claims, 4 Drawing Sheets

2
3
4
5
6
7
8
9
10
11
12
13
14
15
16
17
18
19
20
21
22
23
26
27
28
Z1
Z2
Z3
Z4
Z5'''
Z6'''
Z7'''
Z8'''
S1
S2
W1'''
W2'''
G1'''
G2'''
R1'''
R2'''
R3'''
I'''
R10
R20
R30
M
R40

APPARATUS FOR FRICTIONAL SURFACE DRIVING OF A CROSS-WOUND BOBBIN

BACKGROUND OF THE INVENTION

The present invention relates to mechanisms and apparatus for driving rotation of conical and cylindrical cross-wound textile bobbins and the like, particularly by frictional driving engagement of the peripheral surface of the bobbin. Specifically, the present invention relates to a frictional surface driving apparatus of this type having three or more drive bodies rotatably supported axially adjacent one another on a common central drive shaft.

West German Offenlegungsschrift 24 58 853, which corresponds to U.S. Pat. No. 4,089,480, discloses a textile bobbin winding apparatus wherein a conical cross-wound bobbin is driven peripherally during the winding operation by a cylindrical drive shaft assembly having a plurality of annular drive members independently mounted rotatably in coaxial side-by-side relation. A driven frictional drive roller is mounted for lengthwise reciprocal movement on a supporting drive shaft integrally with a yarn traversing member to peripherally drive the annular drive members individually in sequence as the yarn being wound is traversed back and forth along the bobbin, whereby essentially only the annular drive member whereat yarn is being applied to the bobbin at any given point in the winding operation is actually positively driven by the friction roller. This drive arrangement is a relatively complicated mechanism which generally occupies a significant amount of space. Further, the application of yarn to the cross-wound bobbin in not the most favorable in this arrangement since the bobbin is driven at all times at only one constantly changing location axially along its periphery.

SUMMARY OF THE INVENTION

It is accordingly an object of the present invention to provide an improved drive shaft assembly for frictional peripheral driving of a textile bobbin utilizing multiple axially adjacent drive bodies, which is capable of driving both cylindrical and conical cross-wound bobbins with reproducible accuracy as to bobbin size.

The present invention achieves this objective by providing a frictional surface driving apparatus having a central drive shaft with at least three drive bodies rotatably supported axially adjacent one another on the drive shaft, at least two of the drive bodies being arranged and adapted for peripheral driving engagement with a bobbin. A transmission mechanism is provided for coupling the drive bodies in driven relation to the drive shaft and in speed-change relation to one another at predetermined speed-change ratios. According to the present invention, the speed-change ratios of the transmission mechanism are established as a function of the frictional driving relationship between the bobbin and the two or more drive bodies in frictional driving engagement therewith, as a function of the axial rotational speed of the drive shaft, and as a function of any difference in peripheral dimension between the respective ends of the bobbin. Thus, the drive bodies may be driven at successively increasing or decreasing speeds for driving of a conical cross-wound bobbin or, alternatively, may be driven at a uniform speed for driving of a cylindrical cross-wound bobbin.

Preferably the rotatable drive bodies are of an annular configuration arranged concentrically to the central drive shaft and, as necessary or desirable to simplify assembly, the annular bodies may comprise multiple components. The transmission mechanism is mounted in a fixed relationship to the central drive shaft to rotate unitarily therewith at the same axial rotational speed as the central drive shaft. The provision of at least two of the rotary bodies for frictional driving contact with the bobbin serves to insure reliable driven control of bobbin rotation. Such two or more drive bodies may selectively be disposed axially adjacent one another or at spacings from one another. For example, the two axially outermost rotary drive bodies may be employed for bobbin driving engagement. While essentially any number of the rotary drive bodies may be utilized, three or four drive bodies are normally sufficient.

The present invention thus allows the peripheral, i.e. circumferential, speed of the two or more drive bodies in driving contact with the bobbin periphery to be set in accordance with their respective driving relationships with the bobbin. That is, the peripheral speed of each such drive body can be set according to the particular location axially along the length of the bobbin whereat the drive body contacts the bobbin so that, for example, in the case of a conical bobbin, the respective peripheral speeds of the drive bodies can be established in relation to the varying diameter of the conical bobbin along its length, whereby a relatively precise control of the driving of the bobbin can be assured. Several advantages may thereby be realized. For driving conical bobbins according to their conicity, the speed-change ratios of the transmission mechanism may be selected to establish peripheral driven speeds of one or more of the drive bodies greater than the axial driving speed of the central shaft. Accordingly, a relatively lower rotational speed of the central drive shaft may be set when winding conical cross-wound bobbins. On the other hand, if a conical bobbin is placed on the several drive bodies in the opposite lengthwise orientation, i.e. with the larger diameter end of the conical bobbin in driven relationship with the drive body formerly in drive engagement with the smaller diameter end of the conical bobbin and vice versa, the relationship between the driven speed of the central drive shaft and the peripheral speeds of the drive bodies should be reversed, i.e. the peripheral speed of one or more of the drive bodies should be set to be less than the rotational speed of the central drive shaft. This capability of the present apparatus may be advantageous, for example, when producing large-volume bobbins.

As will be understood, when winding conical bobbins, the transmission mechanism is typically arranged to rotate the drive bodies in the same rotational direction as the central drive shaft, with the drive bodies having a successively increasing or decreasing speed relative to that of the drive shaft. However, it is also possible in accordance with the present invention that the transmission mechanism may be arranged to drive one of the two axially outermost drive bodies in a rotational direction opposite to that of the other axially outermost drive body. Under such circumstances, if one drive body has a greater rotational speed than the central shaft, the other drive body would have a lesser rotational speed than the drive shaft, with the respective rotational speeds of the intervening rotary bodies having intermediate values. This arrangement would be recommended, for example, when it is desired that the average peripheral speed of all of the drive bodies differ as little as possible from the peripheral speed of the central shaft.

The transmission mechanism preferably comprises a drive train which may include meshing toothed gears or frictionally contacting drive rollers or a combination thereof, all of which have certain advantages and disadvantages. Meshing tooth gears maintain a precise during relationship with one another. Frictional drive rollers, on the other hand, are simpler to produce, but cannot be loaded as much as gears of the same dimensions, and, further, they must be selected to have a wear behavior properly coordinated with the service life of the drive apparatus. Nevertheless, since friction rollers tend to slip when overloaded, this slippage can be coordinated with the frictional forces prevailing between the drive bodies and the bobbin surface so that such frictional forces do not adversely affect the bobbin surface, enabling a winding operation to be maintained even under unfavorable conditions such as during starting and stopping procedures. A transmission mechanism employing both meshing toothed gears and frictionally contacting guide rollers enables certain advantages of each to be obtained.

Preferably, the transmission mechanism includes a respective transmission drive train intermediate each adjacent pair of drive bodies, with each drive train having a pair of annular drive surfaces each fixed with respect to a respective one of the associated pair of drive bodies, and a bearing fixedly mounted to the drive shaft intermediate the associated pair of drive bodies, with the bearing rotatably supporting a connecting shaft having a drive member at each opposite end in drive engagement with a respective one of the pair of annular drive surfaces of the associated pair of drive bodies. The annular drive surfaces and the mating drive members may selectively be meshing toothed gears or frictional drive rollers or a combination thereof may be utilized, as aforementioned. The annular drive surfaces may be formed as drive rings, any one or more of which may be arranged to engage its mating drive member either radially inwardly or radially outwardly thereof with respect to the central drive shaft. As will be understood, the selection of a particular arrangement of drive surfaces and drive members is made in accordance with the desired translation ratios as well as whether the drive bodies are to rotate in the same or different directions as one another.

It is also preferred that the speed-change ratios of the transmission mechanism be selected to establish peripheral surface speed differentials between the drive bodies which approximately correspond to the relative axial dimensions thereof. Thus, for example, in an embodiment having three drive bodies, if each adjacent pair of the drive bodies has substantially the same average axial dimension, i.e., the average of the axial dimensions of one adjacent pair of the drive bodies is substantially the same as the average of the axial dimensions of the other adjacent pair of the drive bodies, then the differences between the respective peripheral speeds of each adjacent pair of drive bodies are substantially or approximately equal, which is generally easy to achieve by gear ratios which either increase or decrease from one transmission drive train to another.

It is preferred that the two or more drive bodies which are arranged for frictional drive engagement with the bobbin are provided with an annular friction ring, corrugations, knurlings or the like and have a greater diameter than the other drive body or bodies to insure that the two or more drive bodies selected for driving engagement with the bobbin transmit the primary driving force thereto, thereby establishing an enhanced drive engagement with the bobbin.

In the preferred embodiment, the two axially outermost drive bodies are utilized for frictional driving contact with the bobbin, while the intermediate drive body or bodies are effective essentially only for auxiliary support of the central axial extent of the bobbin intervening the two axially outermost drive bodies. This is especially beneficial over the course of progressive cross-winding of relatively softly or loosely wound bobbins. The intermediate drive body or bodies also assume a support function in this manner when they have a somewhat greater or lesser peripheral speed than the central lengthwise region of the bobbin. Accordingly, it would not be entirely harmful if the speed-change ratios of the transmission mechanism were not precisely set to establish peripheral speed differentials between the drive bodies corresponding to their average axial dimensions.

In a preferred embodiment of the present invention, three drive bodies are utilized with a first transmission drive train intermediate first and second drive bodies and a second transmission drive train intermediate the second and third drive bodies. The first transmission drive train includes an annular drive surface associated with the first drive body and having a pitch circle of a radius of approximately 19 millimeters, a drive member engaged therewith having a pitch circle of a radius of approximately 12 to 14 millimeters, an annular drive surface associated with the second drive body and having a pitch circle of a radius of approximately 22 to 27 millimeters, and a drive member engaged therewith having a pitch circle of a radius of approximately 6 to 9 millimeters, the two drive members being connected as aforementioned to opposite ends of a connecting shaft supported in a bearing fixedly mounted to the central drive shaft. The second transmission drive train includes another annular drive surface associated with the second drive body and having a pitch circle of a radius of approximately 22 millimeters or approximately 41 to 43 millimeters, a drive member engaged therewith having a pitch circle of a radius of approximately 10 to 12 millimeters, an annular drive surface associated with the third drive body and having a pitch circle of a radius of approximately 25 millimeters or approximately 38 millimeters, and a drive member engaged therewith having a pitch circle of a radius of approximately 6 millimeters, the two drive members being fixed to opposite ends of a connecting shaft supported in another bearing fixed to the central drive shaft. In embodiments of the transmission mechanism wherein toothed meshing gears are utilized, one or more of the annular drive surfaces may advantageously be fabricated of a self-lubricating, generally non-deformable plastic material, which provides smooth operating engagement with its meshing gear, maintains a relatively low noise level and enhances the durability of the gear train.

In embodiments of the transmission mechanism utilizing friction rollers, one or more of the annular drive surfaces may advantageously have its frictional surface formed of metal, rubber or a non-deformable plastic material with the drive member engaged therewith formed of rubber, to provide reliable frictional drive transmission therebetween.

According to another aspect of the present invention, the respective drive bodies of each adjacent pair of drive bodies have respective radial faces oriented in adjacent facing relation to one another with a respective recess formed in each radial face. The recesses cooperatively define a groove, preferably at the outer periphery of the drive bodies, in which a sealing member is received for preventing entry of debris between the pair of drive bodies. The sealing member preferably is formed as a ring of a resilient material, which optionally may include a separating line. For example, a ring of spring steel having overlapping terminal ends forming a separating line therebetween, in the nature similar to that of piston rings utilized in motor vehicle engines, may be employed and provides the advantageous ability of being insertable and removable with respect to the drive bodies without requiring any disassembly of the drive apparatus. Alternatively, the sealing member may be formed as a continuous annular ring of an elastomeric material, which advantageously provides an optimal sealing engagement with the drive bodies.

Advantageously, bearings, such as ball bearing assemblies, are utilized for individually rotatably supporting the drive bodies on the central drive shaft. Alternatively, the transmission mechanism may be effective to support and maintain the drive bodies rotatably in assembled relation with the central drive shaft by means of the individual drive surfaces and drive members of the transmission mechanism. To this end, the transmission mechanism, as aforementioned, includes individual transmission drive trains intermediate each adjacent pair of drive bodies. It is also preferred that each transmission mechanism include multiple connecting shafts and associated drive gears uniformly spaced circumferentially about the central drive shaft to provide reliable support for the drive bodies. On the other hand, the additional provision of rotational bearings for supporting the drive bodies rotationally on the central drive shaft, so that the transmission mechanism is not required to serve this additional purpose, advantageously reduces the overall forces applied to the drive components of the transmission mechanism and, in turn, reduces the wear thereof.

Preferably, the rotational bearings which support the drive bodies and the bearings forming part of the transmission mechanism are mounted on a sleeve affixed integrally to the central drive shaft, which provides the advantage of enabling preassembly of the drive bodies and the transmission mechanism on the intermediate sleeve, so that the subsequent mounting of the preassembly on the central drive shaft can be performed more simply and rapidly. The individual annular components of the drive apparatus are preferably formed of two or more component parts which are detachably connected to one another and, in this manner, simplify the subsequent replacement of individual components when necessary. For example, an annular drive body may be formed of two halves which are assemblable with and disassemblable from one another in a radial direction for easy mounting and demounting with respect to the central drive shaft.

In another embodiment of the present drive apparatus, an even number of at least four of the annular drive bodies are utilized. In this embodiment, the speed-change ratios of the transmission mechanism are selected for bobbin winding operations to establish peripheral surface speeds of one axially endwise set of half of the drive bodies which speeds are less than the axial rotational speed of the drive shaft and peripheral surface speeds of the other axially endwise set of half of the drive bodies which speeds are greater than the axial rotational speed of the drive shaft. In this manner, the transmission speed ratios can be made symmetrically between the several adjacent pairs of drive bodies with minimal expense. Further, this embodiment is recommended for operations wherein the average axial rotational speed of the drive bodies is to be essentially the same as the axial rotational speed of the central drive shaft.

BRIEF DESCRIPTION OF THE DRAWINGS

Each of FIGS. 1-5 is a view, partially in side elevation and partially in radial cross-section, of a respective embodiment of a frictional surface driving apparatus for the cross-winding of textile bobbins in accordance with the present invention.

DETAILED DESCRIPTION OF THE PREFERRED EMBODIMENT

Figure 1:
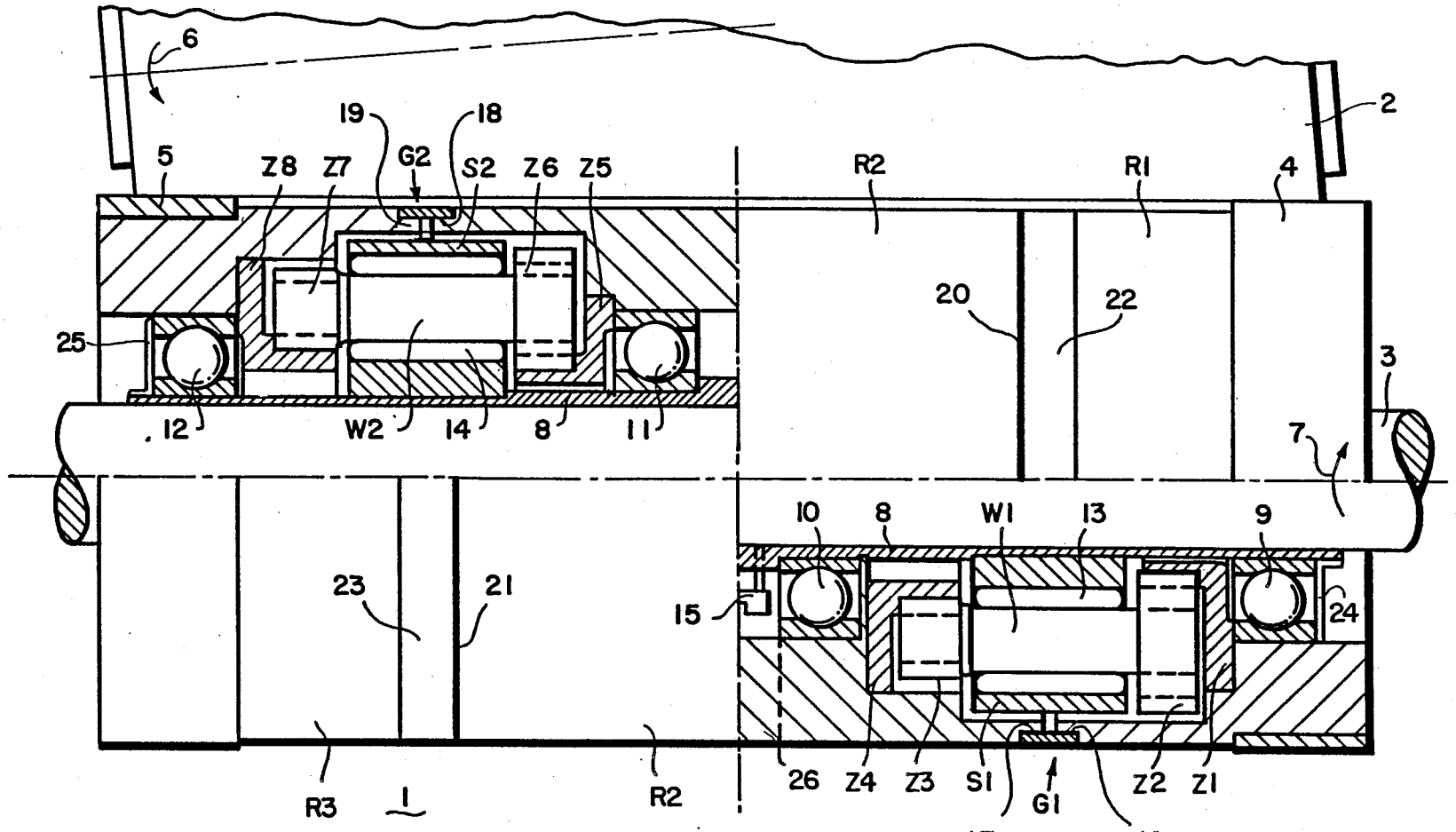

Referring now to the accompanying drawings and initially to FIG. 1, one preferred embodiment of a drive apparatus for frictional surface driving of a textile bobbin for cross-winding of yarn thereon is illustrated and is designated in its totality by 1. The drive apparatus 1 includes three annular rotary drive bodies R1,R2,R3 rotatably supported coaxially adjacent one another on a common central drive shaft 3 for rotation relative thereto. The drive body R1 is peripherally fitted with an annular frictional drive ring 4 and, likewise, the drive body R3 is peripherally fitted with an annular frictional drive ring 5 for peripherally engaging and supporting a cross-wound bobbin 2. In the case of a conical bobbin 2, the larger diameter end of the bobbin rests on the frictional drive ring 4 and the smaller diameter end of the bobbin rests on the frictional drive ring 5. Thus, the two axially outermost rotary drive bodies R1,R3 are arranged for peripheral drive engagement with the bobbin 2. The intermediate rotary drive body R2 serves essentially only to support the bobbin 2 along its central intermediate lengthwise extent intervening the drive rings 4,5 as the bobbin progressively builds, but without the drive body R2 transferring appreciable drive forces to the bobbin 2. As will be understood, the bobbin 2 should be rotatably disposed in a conventional creel or other support structure (not shown) which preferably applies an adjustable force to the bobbin 2 for maintaining in it peripheral driven engagement with the frictional drive rings 4,5. In the embodiment as illustrated, the central drive shaft 3 and, in turn, the drive bodies R1,R2,R3 supported thereon are driven in the rotational direction indicated by arrow 7 and thereby impart an opposite direction of rotation to the bobbin 2 as indicated by the directional arrow 6.

As aforementioned, the rotary drive bodies R1,R2,R3 are preferably of an annular configuration. The drive bodies are mounted individually on an intermediate tubular sleeve 8 by respective appropriate bearings, such as ball bearing assemblies, the rotary drive body R1 being rotatably supported by a ball bearing assembly 9, the rotary drive body R2 being rotatably supported by ball bearing assemblies 10,11, and the rotary drive body R3 being rotatably supported by ball bearing assembly 12. The sleeve 8, in turn, is mounted coaxially on the central drive shaft 3 and held in fixed relation therewith by a retaining screw 15 for unitary rotation of the sleeve 8 with the drive shaft 3.

Each adjacent pair of the rotary drive bodies R1,R2,R3 are coupled to each other by means of respective transmission drive train assemblies, G1,G2, each of which mounted in a fixed relation to the sleeve 8 intermediate an associated adjacent pair of the drive bodies R1,R2,R3, for coupling the drive bodies in driven relation to the central drive shaft 3 and in speed-change relation to one another at predetermined speed-change ratios. Specifically, the drive body R1 is coupled to the drive body R2 by the transmission drive train assembly G1 disposed intermediately therebetween and, likewise, the drive body R2 is coupled to the drive body R3 by the transmission drive train assembly G2 disposed intermediately therebetween. In the embodiment illustrated in FIG. 1, the transmission drive train assemblies G1, G2 employ a series of meshing toothed gears for drive transmission.

The transmission drive train assembly G1 includes a bearing S1 fixedly mounted to the sleeve 8 and, in turn relation with respect to the central drive shaft 3. The bearing S1 rotatably supports a shaft W1 and preferably is of an annular construction, for example, a needle bearing assembly or a roller bearing assembly as indicated at 13, for enhanced symmetry and equilibrium of the bearing S1.

The transmission drive train assembly G1 additionally includes an annular gear Z1 having an exteriorly-toothed annular rim, the rim gear Z1 being affixed coaxially to the drive body R1 adjacent one axial end of the bearing S1. Similarly, another annular gear Z4 having an externally-toothed annular rim is affixed coaxially to the drive body R2 adjacent the opposite axial end of the bearing S1. A pair of spur-type gears Z2,Z3 are affixed to opposite ends of the bearing shaft W1 with the gear Z2 in meshing engagement with the toothed rim of the annular gear Z1 and the gear Z3 in meshing engagement with the toothed rim of the annular gear Z4. In the illustrated embodiment, the toothed rim of the annular gear Z1 has a pitch circle of a radius of approximately 19 millimeters while the spur gear Z2 has a pitch circle of a radius of approximately 12 millimeters. The gear Z3 has a pitch circle of a radius of approximately 9 millimeters and the toothed rim of the annular gear Z4 has a pitch circle of a radius of approximately 22 millimeters.

The transmission drive train assembly G2 is of a basically similar construction to that of the transmission drive train assembly G1. Specifically, the transmission drive train assembly G2 includes a bearing S2, of the same type as the bearing S1 and having a needle or roller bearing assembly 14, fixed to the intermediate sleeve 8 and rotatably supporting a shaft W2. An annular gear Z5 having an exteriorly-toothed annular rim is affixed to the drive body R2 adjacent one axial end of the bearing S2 and, similarly, another annular gear Z8 also having an exteriorly-toothed annular rim is affixed to the drive body R3 adjacent the other axial end of the bearing S2. Spur gears Z6,Z7 are respectively affixed to opposite ends of the shaft W2 with the gear Z6 in meshing engagement with the toothed rim of the annular gear Z5 and the gear Z7 in meshing engagement with the annular rim of the annular gear Z8. In the illustrated embodiment of FIG. 1, the toothed rim of the annular gear Z5 has a pitch circle of a radius of approximately 22 millimeters, the gear Z6 has a pitch circle of a radius of approximately 10 millimeters, the gear Z7 has a pitch circle of a radius of approximately 6 millimeters, and the toothed rim of the annular gear Z8 has a pitch circle of a radius of approximately 25 millimeters.

As best seen in the sectioned portions of FIG. 1, the respective radial faces of the drive bodies R1,R2,R3 which adjacently face one another are each formed with a recess at the outer periphery of the respective drive body, forming shoulders 16,17,18,19 which cooperatively define annular grooves 20,21 respectively between each adjacent pair of the drive bodies. A sealing ring 22 is fitted in the annular groove 20 and a sealing ring 23 is similarly fitted in the annular groove 21 to prevent penetration of dust, fibers and like debris into the transmission drive train assemblies G1,G2. Preferably, the sealing rings 22,23 are formed as a continuous annular ring of an elastomeric material such as rubber, although as aforementioned other forms of annular sealing rings may also be utilized. The bearing assemblies 9,12 which rotatably support the axially outermost drive bodies R1,R3 are also protected against dust, fibers and debris by radial collars 24,25 fitted respectively within the outwardly facing axial ends of the drive bodies R1,R3. In this manner, the rotational bearings and transmission mechanism of the present apparatus are effectively protected against contamination and other potentially harmful environmental influences.

The shafts W1,W2 and the gears Z2,Z3,Z6,Z7 of the transmission drive train assemblies G1,G2 are preferably fabricated of a rigid metallic material, such as steel, while the annular rim-type gears Z1,Z4,Z5,Z8 are preferably fabricated of a different material such as a non-deformable dimensionally stable plastic material, e.g. Delrin brand acetal resin, metal alloys, sintered bronze, or any other suitable conventional material compatible with steel.

The speed-change ratios of the transmission drive train assemblies G1,G2 are selected to establish circumferential and rotational speed differentials between the rotary drive bodies R1,R2,R3 which approximately correspond to the relative axial dimensions of the rotary bodies. For example, in the embodiment of FIG. 1, it will be seen that the axially outermost rotary drive bodies R1,R3 have the same axial dimension while, on the other hand, the intermediate rotary drive body R2 is of a substantially greater axial dimension. Thus, the average of the axial dimensions of the rotary bodies R1 and R2 is equivalent to the average of the axial dimensions of the rotary bodies R2 and R3, and, in turn, the transmission drive train assemblies G1,G2 should be configured according to the present invention to establish a speed differential between the drive bodies R1 and R2 and a speed differential between the drive bodies R2 and R3 which are substantially the same. Therefore, in the embodiment as illustrated, rotation of the central drive shaft 3 in the direction of arrow 7 produces rotation of the drive bodies R1,R2,R3 in the same rotational direction but at respectively increasing speeds.

The provision of the intermediate sleeve 8 enables the bearings 9,10,11,12, the transmission drive train assemblies G1,G2 and the annular drive bodies R1,R2,R3 to be preassembled on the sleeve 8 and then the entire preassembly to be slidably mounted as a unit coaxially onto the central drive shaft 3. In such case, in order to facilitate affixation of the preassemblies to the central drive shaft 3, a bore such as indicated at 26 is formed radially in the drive body R2 at the location of the screw 15 to provide easy access to the screw 15 with a screwdriver or other driving tool. A suitable plug or other closure is fitted in the bore 26 after installation of the preassembly on the drive shaft 3 to prevent penetration of dust, fibers and other debris into the bore 26.

Figure 2:
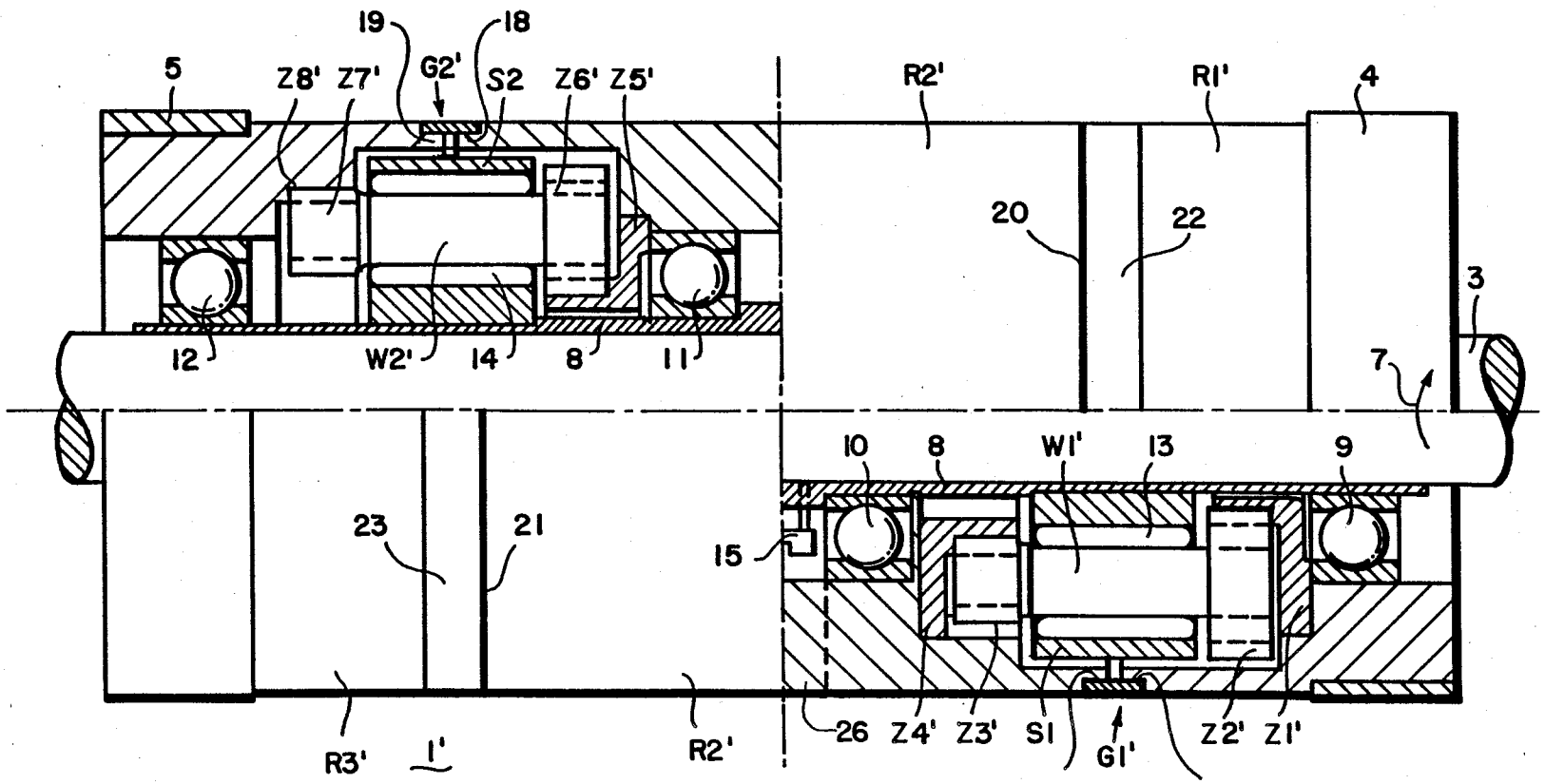

Referring now to FIG. 2, an alternative embodiment of drive apparatus is indicated at 1' and differs essentially from the construction of the drive apparatus 1 of FIG. 1 in that the annular gear Z8 of the drive device 1 is eliminated and, instead, an annular arrangement of gear teeth are milled into a radially inwardly facing annular surface Z8' of the drive body R3' to form an internally toothed gear surface which meshes with the spur gear Z7' of the transmission drive train assembly G2'. Otherwise, the drive apparatus 1' differs from the drive apparatus 1 only in the pitch circle radii of the various gears of the transmission mechanism, the following pitch circle radii being provided: annular rim gear Z1':19 millimeters; spur gear Z2':14 millimeters; spur gear Z3':6 millimeters; annular rim gear Z4':27 millimeters; annular rim gear Z5':22 millimeters; spur gear Z6':10 millimeters; spur gear Z7':6 millimeters; and annular rim gear Z8':38 millimeters. As will be understood, the replacement of the exteriorly toothed annular rim gear Z8 with the internally toothed surface Z8' on the drive body R3' causes the transmission drive train assembly G2 to transmit rotary motion to the drive body R3' in an opposite direction from that of the central drive shaft 3 and the drive bodies R1' and R2'.

Figure 3:
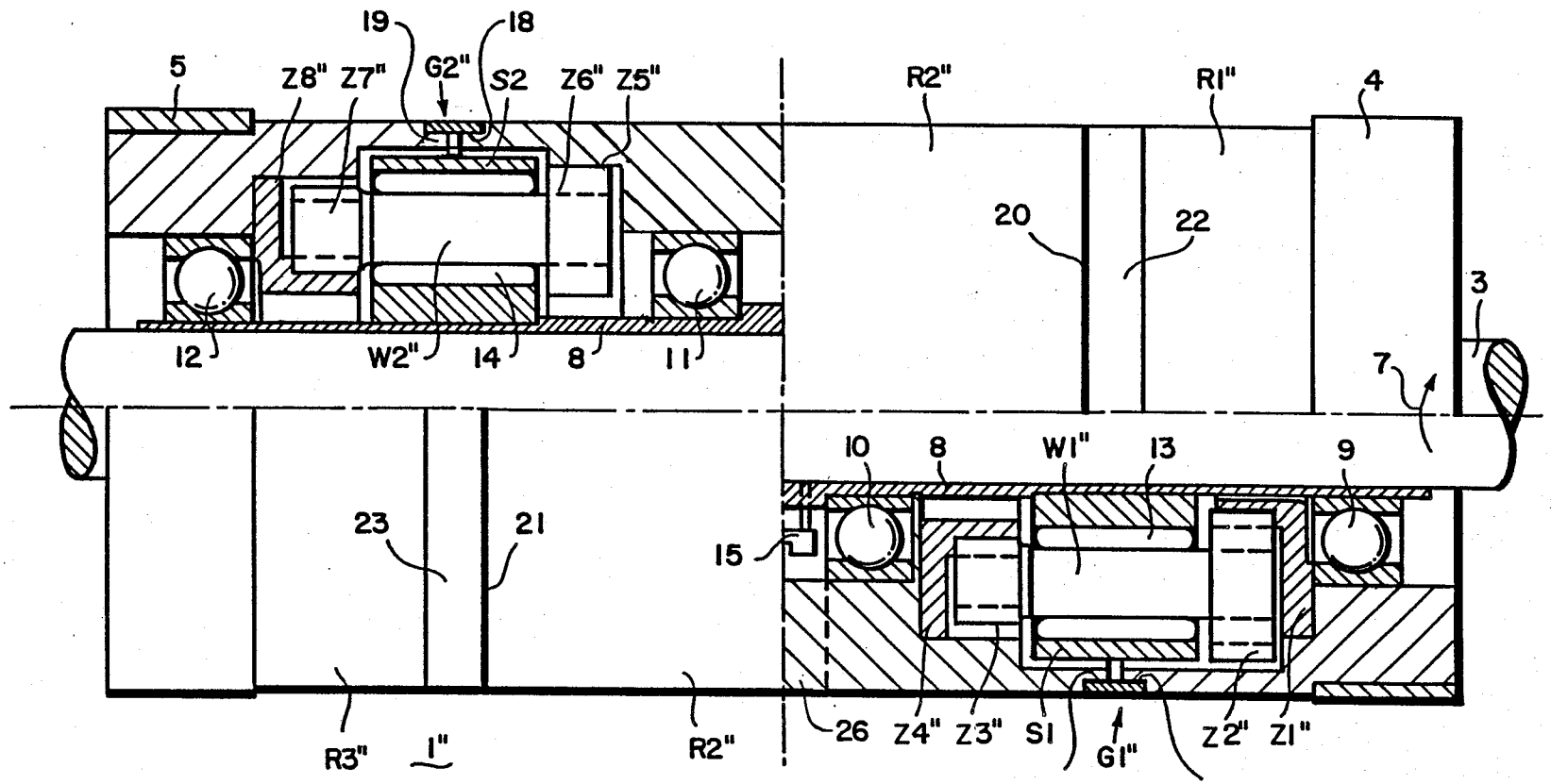

FIG. 3 illustrates a drive apparatus 1" in accordance with another embodiment of the present invention, which differs from the embodiments of FIGS. 1 and 2 in that the transmission drive train assembly G2" utilizes an annular friction drive surface Z5" formed in a radially inwardly facing surface of the rotary drive body R2" and a mating friction roller Z6" affixed to the shaft W2" in frictional driven engagement with the drive surface Z5", instead of the meshing gear sets Z5,Z6 of FIG. 1 and Z5',Z6' of FIG. 2. Similarly to the drive apparatus 1 of FIG. 1, the opposite end of the shaft W2" carries a spur gear Z7" in meshing engagement with the exteriorly toothed rim of an annular rim-type gear Z8" fitted to the drive body R3". The drive components of the transmission mechanism have the following pitch circle radii in the drive apparatus 1" of FIG. 3: annular rim-type gear Z1":19 millimeters; spur gear Z2":12 millimeters; spur gear Z3":6 millimeters; annular rim-type gear Z4":25 millimeters; annular frictional drive surface Z5":41 millimeters; friction roller Z6":10 millimeters; spur gear Z7":6 millimeters; and annular rim-type gear Z8":25 millimeters. As will be understood, the transmission drive train assembly G1" of the drive apparatus 1" of FIG. 3 serves to transmit rotary motion to the drive bodies R1",R2" in the same rotational direction as the central drive shaft 3 at speed differentials governed by the respective pitch circles of the drive gears, whereas on the other hand, the transmission drive train assembly G2" transmits rotary motion to the drive body R3" in the opposite rotational direction with an additional speed-change.

Figures 4, 5:
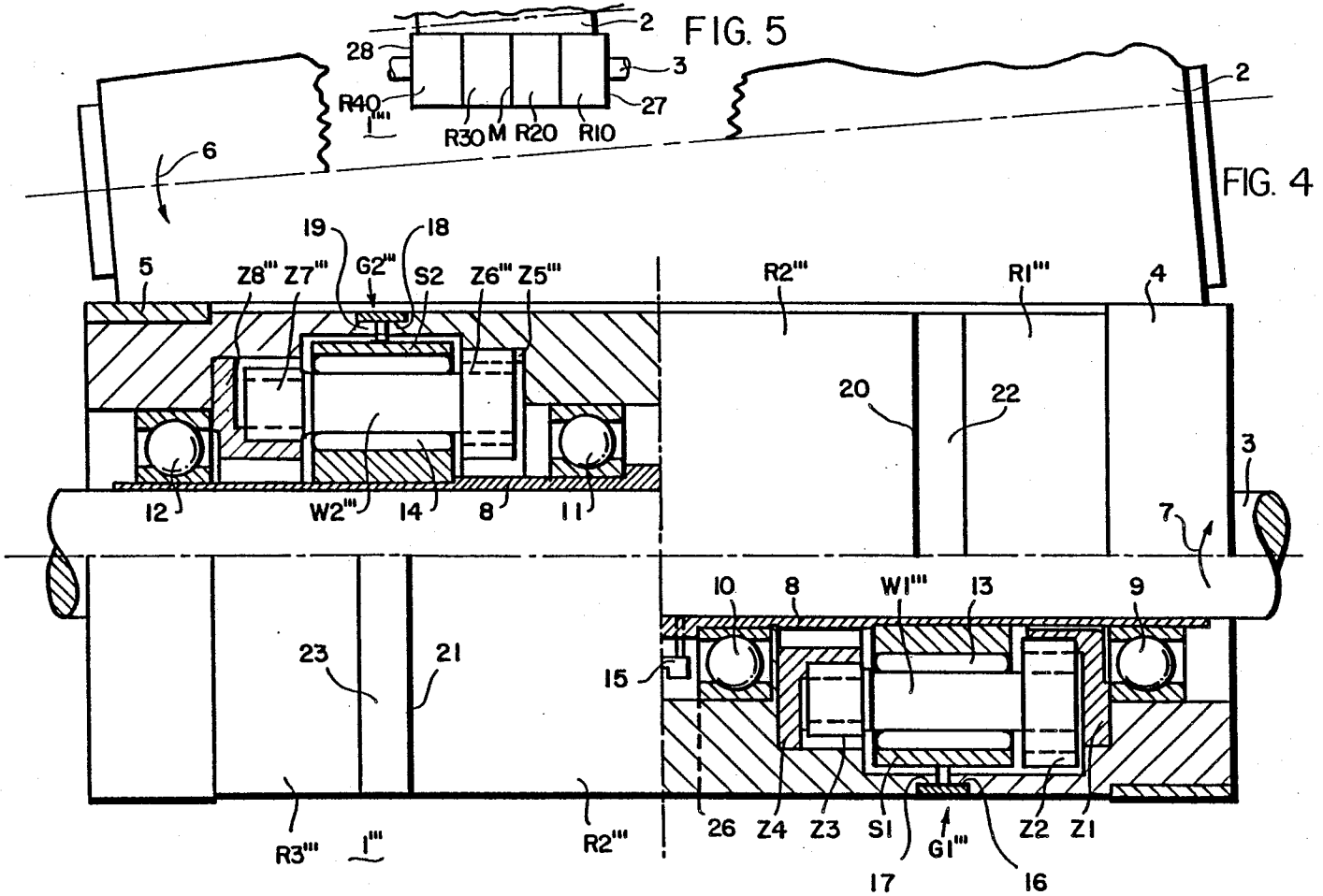

In FIG. 4, another drive apparatus 1''' is illustrated according to a further embodiment of the present invention. The drive apparatus 1''' differs from the drive apparatus 1" of FIG. 3 only in that a toothed drive gear surface Z5'''is formed in the radially inward annular surface of the drive body R2'''instead of the frictional drive surface Z5" of FIG. 3 and a meshing spur gear Z6''' is affixed to the drive shaft W2''' instead of the friction roller Z6" of FIG. 3. Thus, in the embodiment of FIG. 4, each of the transmission drive train assemblies G1''' and G2''' are comprised entirely of meshing toothed gears. The pitch circle radii of the drive gears is the same in the drive apparatus 1''' of FIG. 4 as in the drive apparatus 1" of FIG. 3.

FIG. 5 illustrates a drive apparatus 1''' according to another embodiment of the present invention wherein a total of four rotary drive bodies R10,R20,R30,R40, each of an identical axial dimension, are rotationally supported on the central drive shaft 3 and, as will be understood, the adjacent pairs of drive bodies are respectively coupled to one another by three intermediate transmission drive train assemblies. By way of example, a transmission drive train assembly G1 as in FIG. 1 may be provided between the drive bodies R10 and R20 and, likewise, between the drive bodies R30 and R40, while on the other hand a transmission drive train assembly G2'''' as in FIG. 4 is provided between the drive bodies R20 and R30. Since an even number of the drive bodies are provided and each is of the same axial dimension as the others, the central location at which the intermediate pair of drive bodies 20,30 are coupled defines the axial midpoint M along the length of the drive apparatus 1''''. The gear ratios of the several transmission drive train assemblies are selected so that, during the winding of a conical cross-wound bobbin, the axial endwise pair of drive bodies, R10,R20 to one axial side of the midpoint M rotate relatively faster than the central drive shaft 3 while the other axial endwise pair of drive bodies R30,R40 to the other axial side of the midpoint M rotate relatively slower than the central drive shaft 3. Further, the gear ratios are set to establish substantially the same peripheral speed differential between each adjacent pair of the drive bodies.

The embodiment of FIG. 5 is recommendable when the average rotational speed of the several drive bodies should at least approximately correspond to the rotational speed of the central drive shaft 3 independently of the degree of the particular conicity of the bobbin 2 being cross-wound.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. Apparatus for frictional surface driving of a bobbin for cross-winding of yarn thereof, comprising a central drive shaft, at least three drive bodies rotatably supported axially adjacent one another on said drive shaft, at least two of said drive bodies being arranged for peripheral drive engagement with the bobbins, and transmission means coupling said drive bodies in driven relation to said drive shaft and in speed-change relation to one another at predetermined speed-change ratios established as a function of the frictional driving relationship between said at least two drive bodies and the bobbin, as a function of the axial rotational speed of said drive shaft, and as a function of any difference in peripheral dimension between respective ends of the bobbin, said transmission means comprising a respective transmission drive train intermediate each adjacent pair of drive bodies, each drive train including a pair of annular drive surfaces each of which is fixed with respect to a respective one of the associated pair of drive bodies, a bearing fixedly mounted with respect to said drive shaft intermediate the associated pair of drive bodies, said bearing rotatably supporting a connecting shaft having a drive member at each opposite end in drive engagement with a respective one of said pair of annular drive surfaces of the associated pair of drive bodies.

2. Apparatus for frictional surface driving of a bobbin for cross-winding of yarn thereon according to claim 1 and characterized further in that said transmission means is arranged for causing one of said at least two drive bodies to rotate in an opposite direction from the other thereof.

3. Apparatus for frictional surface driving of a bobbin for cross-winding of yarn thereon according to claim 1 and characterized further in that said transmission means comprises a drive train including meshing toothed gears.

4. Apparatus for frictional surface driving of a bobbin for cross-winding of yarn thereon according to claim 1 and characterized further in that said transmission means comprises a drive train including drive rollers in frictional surface contact with one another.

5. Apparatus for frictional surface driving of a bobbin for cross-winding of yarn thereon according to claim 1 and characterized further in that said transmission means comprises a drive train including meshing toothed gears and drive rollers in frictional surface contact with one another.

6. Apparatus for frictional surface driving of a bobbin for cross-winding of yarn thereon according to claim 1 and characterized further in that said speed-change ratios of said transmission means are selected to establish peripheral surface speed differentials between said drive bodies which approximately correspond to the relative axial dimensions thereof.

7. Apparatus for frictional surface driving of a bobbin for cross-winding of yarn thereon according to claim 1 and characterized further in that said each of said at least two drive bodies has an annular engagement surface for enhanced frictional contact with the bobbin.

8. Apparatus for frictional surface driving of a bobbin for cross-winding of yarn thereon according to claim 1 and characterized further in that said at least two drive bodies are the two axially outermost drive bodies, each intermediate drive body being effective for auxiliary support of the region of the bobbin intervening said two axially outermost drive bodies.

9. Apparatus for frictional surface driving of a bobbin for cross-winding of yarn thereon according to claim 1 and characterized further in that a first transmission drive train intermediate a first drive body and a second drive body comprises an annular drive surface associated with said first drive body and having a pitch circle of a radius of approximately 19 millimeters, a drive member engaged therewith having a pitch circle of a radius of approximately 12 to 14 millimeters, an annular drive surface associated with said second drive body and having a pitch circle of a radius of approximately 22 to 27 millimeters, and a drive member engaged therewith having a pitch circle of a radius of approximately 6 to 9 millimeters, and a second transmission drive train intermediate said second drive body and a third drive body comprises another annular drive surface associated with said second drive body and having a pitch circle of a radius of one of approximately 22 millimeters and approximately 41 to 43 millimeters, a drive member engaged therewith having a pitch circle of a radius of approximate 10 to 12 millimeters, an annular drive surface associated with said third drive body and having a pitch circle of a radius of one of approximately 25 millimeters and approximately 38 millimeters, and a drive member engaged therewith having a pitch circle of a radius of approximately 6 millimeters.

10. Apparatus for frictional surface driving of a bobbin for cross-winding of yarn thereon according to claim 1 and characterized further in that at least one of said annular drive surfaces comprises a toothed gear fabricated of a self-lubricating, generally non-deformable plastic material.

11. Apparatus for frictional surface driving of a bobbin for cross-winding of yarn thereon according to claim 1 and characterized further in that at least one of said annular drive surfaces is a frictional surface formed of one of a metal, rubber and non-deformable plastic material and the drive member engaged therewith is a friction roller formed of rubber.

12. Apparatus for frictional surface driving of a bobbin for cross-winding of yarn thereon according to claim 1 and characterized further in that each adjacent pair of said drive bodies have radial faces oriented in adjacent facing relation to one another, a respective recess in each radial face, and a sealing member received in said recess for preventing entry of debris between said pair of drive bodies.

13. Apparatus for frictional surface driving of a bobbin for cross-winding of yarn thereon according to claim 12 and characterized further in that said sealing member is fabricated of a resilient material.

14. Apparatus for frictional surface driving of a bobbin for cross-winding of yarn thereon according to claim 12 and characterized further in that said sealing member comprises an annular elastomeric ring.

15. Apparatus for frictional surface driving of a bobbin for cross-winding of yarn thereon according to claim 1 and characterized further by bearings rotatably supporting said drive bodies on said drive shaft.

16. Apparatus for frictional surface driving of a bobbin for cross-winding of yarn thereon according to claim 1 and characterized further in that said transmission means maintains said drive bodies in assembled relation with said drive shaft.

17. Apparatus for frictional surface driving of a bobbin for cross-winding of yarn thereon according to claim 1 and characterized further by a sleeve affixed integrally to said drive shaft, said transmission means being mounted to said sleeve.

18. Apparatus for frictional surface driving of a bobbin for cross-winding of yarn thereon according to claim 1 and characterized further in that an even number of at least four said annular drive bodies are provided, said speed-change ratios of said transmission means being selected for bobbin winding operations to establish peripheral surface speeds of one axially endwise set of half of said drive bodies which speeds are less than the axial rotational speed of said drive shaft and peripheral surface speeds of the other axially endwise set of half of said drive bodies which speeds are greater than the axial rotational speed of said drive shaft.

19. Apparatus for frictional surface driving of a bobbin for cross-winding of yarn thereon, comprising a central drive shaft, at least three drive bodies rotatably supported axially adjacent one another on said drive shaft, at least two of said drive bodies being arranged for peripheral drive engagement with the bobbins, and transmission means coupling said drive bodies in driven relation to said drive shaft and in speed-change relation to one another at predetermined speed-change ratios established as a function of the frictional driving relationship between said at least two drive bodies and the bobbin, as a function of the axial rotational speed of said drive shaft, and as a function of any difference in peripheral dimension between respective ends of the bobbin, each adjacent pair of said drive bodies having radial faces oriented in adjacent facing relation to one another, a respective recess in each radial face, and a sealing member received in said recesses for preventing entry of debris between said pair of drive bodies.

20. Apparatus for frictional surface driving of a bobbin for cross-winding of yarn thereon according to claim 19 and characterized further in that said sealing member is fabricated of a resilient material.

21. Apparatus for frictional surface driving of a bobbin for cross-winding of yarn thereon according to claim 19 and characterized further in that said sealing member comprises an annular elastomeric ring.

22. Apparatus for frictional surface driving of a bobbin for cross-winding of yarn thereon, comprising a central drive shaft, an even number of at least four drive bodies rotatably supported axially adjacent one another on said drive shaft, at least two of said drive bodies being arranged for peripheral drive engagement with the bobbins, and transmission means coupling said drive bodies in driven relation to said drive shaft and in speed-change relation to one another at predetermined speed-change ratios established as a function of the frictional driving relationship between said drive bodies and the bobbin, as a function of the axial rotational speed of said drive shaft, and as a function of any difference in peripheral dimension between respective ends of the bobbin, said speed-change ratios of said transmission means being selected for bobbin winding operations to establish peripheral surface speeds of one axially endwise set of half of said drive bodies which speeds are less than the axial rotational speed of said drive shaft and peripheral surface speeds of the other axially endwise set of half of said drive bodies which speeds are greater than the axial rotational speed of said drive shaft.

* * * * *